United States Patent [19]

Berner et al.

[11] Patent Number: 4,808,952

[45] Date of Patent: Feb. 28, 1989

[54] MAGNETIC TRIGGER FOR A SELECTIVELY OPERATIVE SWITCH

[75] Inventors: Jörg Berner, Rupperswil; Markus Anliker, Gränichen; Willy Feller, Rombach; Werner Breer, Oberentfelden, all of Switzerland

[73] Assignee: Sprecher & Schuh AG, Aarau, Switzerland

[21] Appl. No.: 132,834

[22] Filed: Dec. 14, 1987

[30] Foreign Application Priority Data

Dec. 23, 1986 [CH] Switzerland ..... 05203/86

[51] Int. Cl.[4] ..... H01H 75/10

[52] U.S. Cl. ..... 335/41; 335/35; 335/172; 335/119

[58] Field of Search ..... 335/35, 21, 38, 41, 335/23, 172, 168, 169, 170, 173, 185, 194, 119, 120, 121, 128

[56] References Cited

U.S. PATENT DOCUMENTS 4,276,526 6/1987 Ciarcia et al. ..... 335/35
4,697,163 9/1987 Grunert et al. ..... 335/41

FOREIGN PATENT DOCUMENTS 0148112 12/1984 European Pat. Off. .
854568 11/1952 Fed. Rep. of Germany .
2115030 10/1972 Fed. Rep. of Germany .
3132194 3/1983 Fed. Rep. of Germany .

*Primary Examiner*—E. A. Goldberg
*Assistant Examiner*—L. Donovan
*Attorney, Agent, or Firm*—Werner W. Kleeman

[57] ABSTRACT

There are arranged at a magnetic trigger for a selectively operative switch, a plunger-type armature, a pivotable armature and a tripping device. A plunger of the plunger-type armature acts directly upon a movable contact of a pair of contacts and the plunger-type armature is actuated using a magnetic coil or winding when the current flowing through the magnetic coil at least corresponds to a predetermined threshold current for opening the contacts. A pivotable armature is actuated by the plunger-type armature and redirects the magnetic return flux. The tripping device acts upon a switch lock mechanism and is switched into or out of the magnetic return flux by the plunger-type armature. The degree of overlap between pole shoes of the pivotable armature and of the tripping device is preselectable by an adjusting screw. There is thus realized a current-dependent, selective tripping of the switch lock mechanism.

12 Claims, 2 Drawing Sheets

FIG. 3
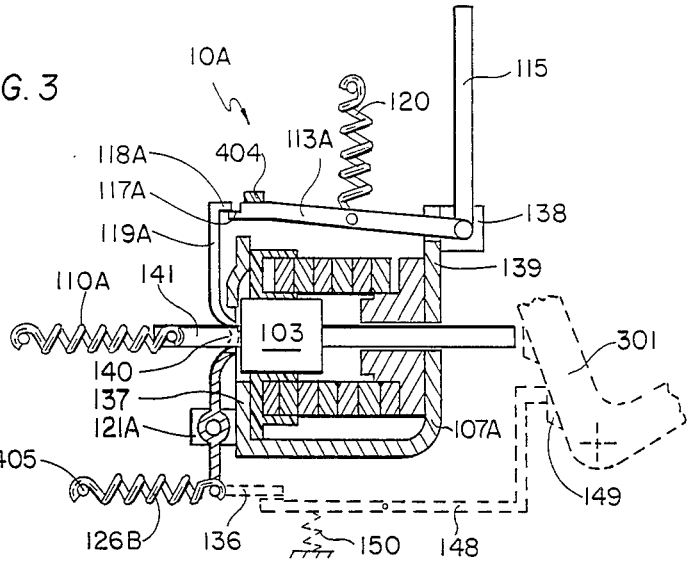
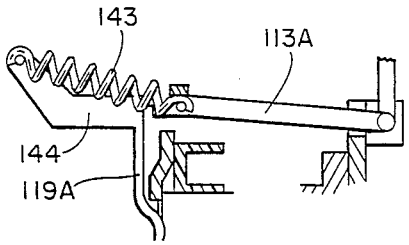
FIG. 4
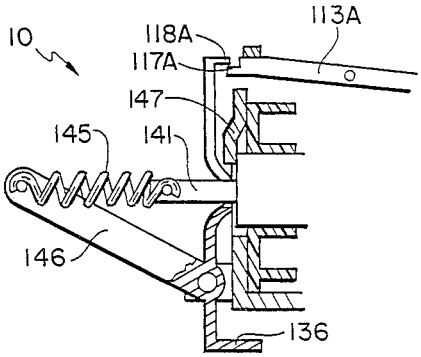
FIG. 5
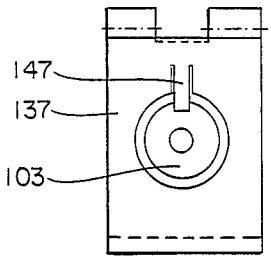
FIG. 6
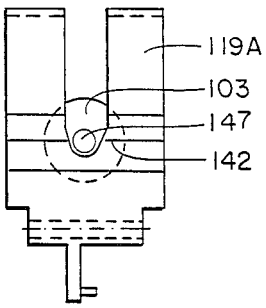
FIG. 7

MAGNETIC TRIGGER FOR A SELECTIVELY OPERATIVE SWITCH

BACKGROUND OF THE INVENTION

The present invention relates to a new and improved construction of a magnetic triggering apparatus or magnetic trigger for a selectively operative switch.

In its more specific aspects, the present invention relates to a new and improved construction of a magnetic triggering apparatus for a selectively operative switch, containing a plunger-type armature which is actuated by means of a magnetic coil or winding when there is flowing therethrough a current at least corresponding to a predetermined threshold or tripping current at which the contacts of the switch open. The plunger of the plunger-type armature acts upon a movable contact of the switch.

A magnetic triggering apparatus of such type is known, for example, from German Patent Publication No. 2,854,568. This publication also refers to the places of application, tasks and modes of operation of selective protective devices. With respect to the specifically described magnetic triggering apparatus, a plunger-type armature is actuated by means of a magnetic coil or winding when supplied with a current exceeding a predetermined threshold or tripping current. An extension of the plunger-type armature acts upon a movable contact and can open this movable contact. When the current decreases, the plunger-type armature is returned into its rest or inoperative position by the force of a spring. During such return movement, the plunger-type armature impacts upon a further extension which transmits this movement to a spring-loaded lever arrangement. A spring-loaded rod is rotatably attached to this lever arrangement and thus is swivelled in front of the extension of the plunger-type armature. When now a second current half cycle flows through the magnetic coil or winding during the residence or dwell time of the rod in front of the extension of the plunger-type armature, the extension of the plunger-type armature impacts upon the rod which, in turn, triggers the switch lock mechanism.

A further, selectively operative trigger is known from German Patent Publication No. 3,347,121 and U.S. Pat. No. 4,599,590, granted July 8, 1986. Therein, a U-shaped, spring-loaded lever arrangement embraces the magnetic trigger. When the striking or impact armature is first actuated, the plunger of the striking or impact armature impacts upon the lever arrangement. When the spring-loaded striking or impact armature recoils, a rearwardly-located extension moves the lever arrangement out of the effective range of the plunger, which can trigger a switch lock mechanism during a subsequent second current half cycle. It is a disadvantage of this type of magnetic trigger that the contacts for limiting the current are not opened by means of the striking or impact armature.

Furthermore, a magnetic trigger of an automatic switch such as known, for example, from German Patent Publication No. 2,115,030 contains a plunger-type armature which directly acts upon the movable contacts. A pivotable armature is arranged at the magnet yoke and, in its rest or inoperative position, supports the ratchet lever of the switch lock mechanism. When a tripping current flows through the coil of the magnet system, the pivotable armature is first attracted and releases the ratchet lever of the switch lock mechanism.

As a result of the reduced air gap due to the attracted pivotable armature, the magnetic field is increased or strengthened such that the plunger-type armature is also pulled into the coil and the contacts open. Such a magnetic trigger is not suitable for selective switch triggering.

SUMMARY OF THE INVENTION

Therefore, with the foregoing in mind, it is a primary object of the present invention to provide a new and improved construction of a magnetic triggering apparatus for a selectively operative switch and which apparatus is not afflicted with the aforementioned drawbacks and shortcomings of the prior art constructions.

Another important object of the present invention aims at the provision of an improved construction of a magnetic triggering apparatus for a selectively operative switch and which apparatus contains a plunger-type armature which can act upon movable contacts for current limitation at each response.

Still a further significant object of the present invention is directed to providing a new and improved construction of a magnetic triggering apparatus for a selectively operate switch and which apparatus is equipped with particularly rapidly opening contacts.

Another significant object of the present invention aims at the provision of a new and improved construction of a magnetic triggering apparatus for a selectively operative switch and which apparatus has an adjustable selectivity.

Now in order to implement these and still further objects of the invention which will become more readily apparent as the description proceeds, the magnetic triggering apparatus of the present invention is manifested by the features that, a pivotable armature, which can be directly or indirectly actuated by means of the plunger-type armature and which redirects the magnetic return flux, and tripping means acting upon a switch lock mechanism are arranged at the magnetic triggering apparatus.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 3 is a partially sectional view of a second exemplary embodiment of an inventive triggering apparatus;

FIG. 4 illustrates a modified spring arrangement in the triggering apparatus as shown in FIG. 3;

FIG. 5 illustrates an other modified spring arrangement in the triggering apparatus as shown in FIG. 3;

FIG. 6 is a view of the iron enclosure in the triggering apparatus as shown in FIG. 3; and FIG. 7 is a view of the pivotable armature in the magnetic triggering apparatus as shown in FIG. 3.

DETAILED DESCRIPTION OF THE PREFERRED EMBODIMENTS

Figure 1:
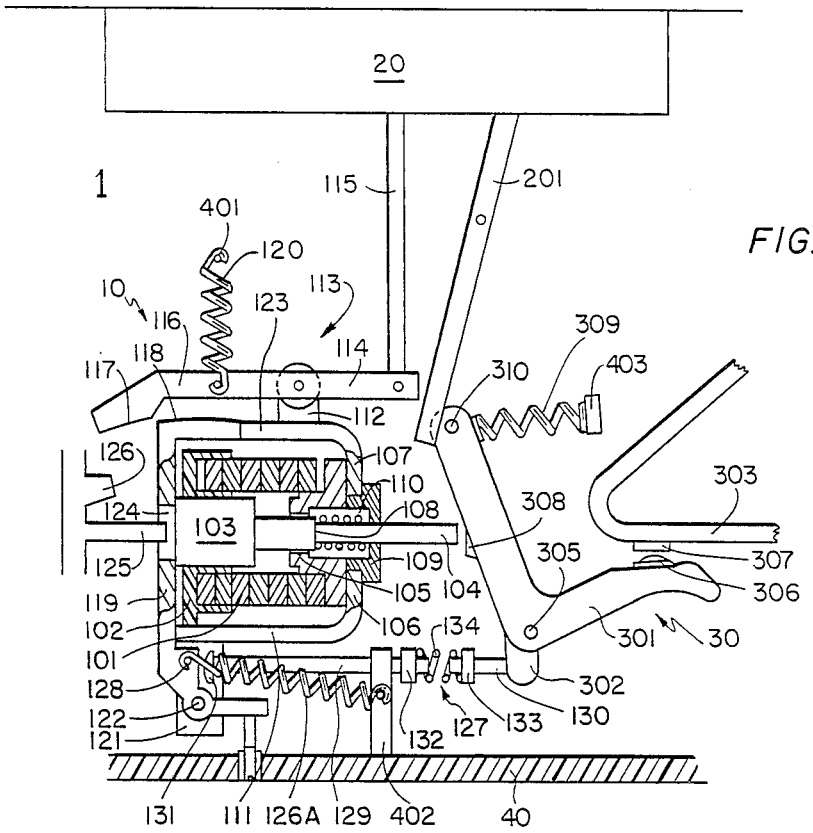
FIG. 1 shows a partially sectional view of a first exemplary embodiment of the inventive magnetic triggering apparatus in its inoperative position.

Describing now the drawings, it is to be understood that to simplify the showing thereof only enough of the structure of the inventive magnetic triggering apparatus or magnetic trigger has been illustrated therein as needed to enable one skilled in the art to readily understand the underlying principles and concepts of the present invention. Turning now specifically to FIG. 1 of the drawings, there are shown therein as a matter of example but not limitation the most important parts of an interruption unit, in part only schematically, namely a selectively operative switch 1, a magnetic triggering apparatus 10, a switch lock mechanism 20, a contact system 30 and a part of the base of the housing 40 surrounding the switch 1. For multiphase networks, several such interruption units are arranged in parallel, and all of the magnetic triggering apparatuses 10 may act upon a common switch lock mechanism 20. Movable contacts 301 of the contact systems 30 can be mechanically coupled to each other so that, upon the response of the magnetic triggering apparatus 10 associated with only one phase of the multiphase network, all contact systems 30 are caused to be opened.

In the magnetic triggering apparatus 10 a magnetic coil or winding 101 is electrically connected in series with the movable contact 301 and the current to be interrupted flows through such magnetic coil or winding 101. The magnetic coil or winding 101 is carried by an electrically insulating coil former or spool 102 which guidingly accommodates a plunger-type armature 103 in a cylindrical bore with small play. A plunger 104 is mounted at the plunger-type armature 103 and passes through a bore 105 of a core 106 which partially extends into the interior of the magnetic coil or winding 101.

An iron enclosure 107 is affixed to the core 106 on the side which is remote from the magnetic coil or winding 101. The iron enclosure 107 is also punched through so that the bore 105 is prolonged and the plunger 104 can reciprocate in a practically frictionless manner. A return spring 110 arranged in the bore 105 is supported at one end at a shoulder 108 of the plunger 104 and is held at the other end by a threaded cap 109. The return spring 110 holds the plunger-type armature 103 in its rest or inoperative position as shown in FIG. 1.

The iron enclosure 107 embraces or partially encloses the magnetic coil or winding 101 in a substantially U-shaped manner. A lower leg 111 of the substantially U-shaped iron enclosure 107 as viewed in FIG. 1, protrudes beyond the coil former 102. An upper leg 123 of the substantially U-shaped iron enclosure 107, as viewed in FIG. 1, only extends up to the central region of the magnetic coil or winding 101. A tripping lever 113 of tripping means 113, 115 is rotatably mounted at a flange 112 of the upper leg 123 of the iron enclosure 107. The tripping lever 113 is constructed as a two-armed lever and contains a first lever arm 114 to which a tripping rod 115 is rotatably coupled. The tripping rod 115 transmits the movement of the tripping lever 113 to the switch lock mechanism 20. The end of a second lever arm 116 of the tripping lever 113 is constructed as a pole shoe 117. The cooperation of this pole shoe 117 with a pole shoe 118 of a pivotable armature 119 will be described further hereinbelow. Approximately centrally of the second lever arm 116, a retaining spring 120 engages the second lever arm 116 and is supported at its other end at a pin 401 fixed at the housing 40.

A swivel axle or shaft 122 is attached to a downwardly bent lug 121 of the lower leg 111 of the iron enclosure 107. The pivotable armature 119 is rotatably mounted at the pivot axle or shaft 122. In combination with multiphase network switches, the pivot axle or shaft 122 may be common for all phases; in this event, the pivot axle or shaft 122 is fixedly connected to the pivotable armatures 119 and rotatably guided in holes of the lugs 121.

The pivotable armature 119 contains an end section which is remote from the pivot axle or shaft 122 and bent to form a substantially L-shape. In the inoperative position of the pivotable armature 119 as shown in FIG. 1, the end of the shorter leg or bent-off end of the L-shape bears against the upper leg 123 of the iron enclosure 107. The surface of the bent-off end of the substantially L-shaped pivotable armature 119 and which surface is directed towards the second lever arm 116 of the tripping lever 113, is constructed as a pole shoe 118. Such surface has a shape substantially corresponding to a segment of a substantially cylindrical surface defined by a radius extending from the pivot axle or shaft 122 to the surface of the pole shoe 118. The surface of the pole shoe 117 of the tripping lever 113 is correspondingly formed or shaped so that, when the pivotable armature 119 is pivoted out of its rest or inoperative position, a gap of substantially constant width is formed between the pole shoes 117 and 118, see FIG. 2.

In the region of the plunger-type armature 103, a through bore 124 in the pivotable armature 119 opens a space and a stop member 125 of the housing 40 protrudes into approximately the center of such space. A second stop member 126 limits the pivoting movement of the pivotable armature 119.

A pivotable armature spring 126A has one end which is attached to a guide member 402 which is connected, for example, by casting with the housing 40, for guiding a transmitting plunger 127. An other end of the pivotable armature spring 126A engages a holding pin 128 of the pivotable armature 119. The pivotable armature 119 thus is biased into its rest or inoperative position.

The transmitting plunger 127 is subdivided into two plunger portions 129 and 130. The head 131 of a first plunger portion 129 bears against the pivotable armature 119. The end of a second plunger portion 130 and which end is remote from the first plunger portion 129 cooperates with an extension 302 extending from the movable contact 301. The mutually facing ends of the plunger portions 129 and 130 are held spaced from each other by means of a compression spring 134 which encloses such ends and is supported at stop members 132 and 133.

The contact system 30, as mentioned previously, comprises a movable contact 301 and a stationary contact 303. The stationary contact 303 is bent to a substantially U-shape so that it forms, together with an electric arc which may be formed when the contacts 301 and 303 are separated and the movable contact 301, a current loop by means of which the electric arc is driven onto a guide rail and into an extinguishing or quenching chamber which is conventional and therefore not illustrated. The movable contact 301 is constructed in a substantially L-shape and rotatably mounted in the region of the joint of its two legs at a pivot axle or shaft 305 supported at the housing 40. The abovementioned extension 302 likewise is formed or connected, for example, by casting with the movable contact 301 in the vicinity of the pivot axle or shaft 305.

A contact head 306 is mounted at the shorter leg of the substantially L-shaped movable contact 301 and this contact head 306 forms a separable contact together with a contact head 307 which is mounted at the stationary contact 303.

In the central region of the longer leg of the substantially L-shaped movable contact 301, a stop dog 308 formed or connected, for example, by casting and cooperates with the plunger 104 of the plunger-type armature 103.

A contact pressure spring 309 is supported at a housing extension 403 and subjects the movable contact 301 to a force in the direction of the switch-on or closed position. The longer leg of the substantially L-shaped movable contact 301 carries an entraining axle or shaft 310 at its outer end region. An actuating rod 201 controlled by the switch lock mechanism 20 can engage at such entraining axle or shaft 310 and entrain the movable contact 301 in a switching-off direction.

Figure 2:
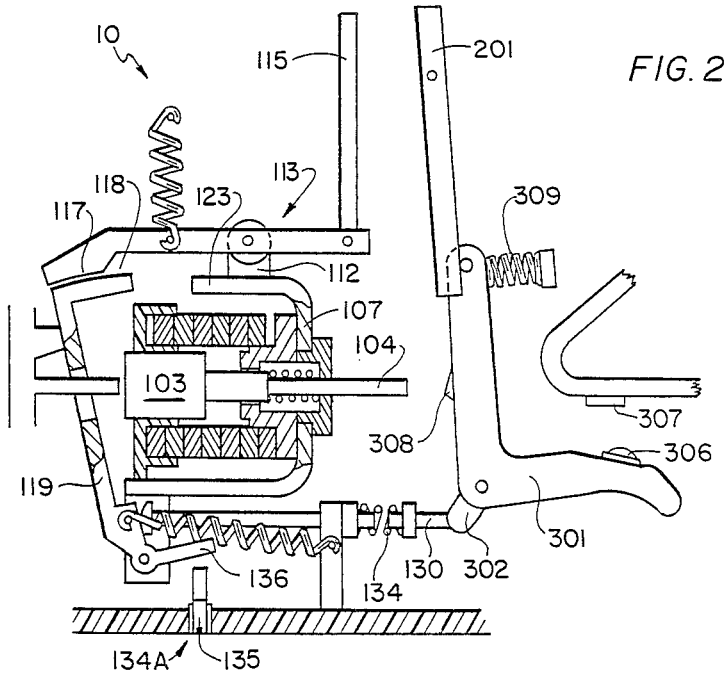
FIG. 2 is a similar view of the magnetic triggering apparatus shown in FIG. 1 in its operative position.

FIG. 2 shows the aforedescribed magnetic triggering apparatus 10 in a switch-off or open position of the contacts 301 and 303. In order to provide a better overview, not all the parts of FIG. 1 are illustrated in FIG. 2 and provided with reference numerals. In FIG. 2 there are shown adjustable selecting means 134A for adjusting the response selectivity. In the base of the housing 40, an externally operable adjusting screw 135, which constitutes the adjustable selecting means 134A, is rotatably mounted. A lever 136 is connected, for example, as by casting with the pivotable armature 119 and can abut the adjusting screw 135. Alternatively the adjusting screw 135 can directly act upon the pivotable armature 119. The rest or inoperative position of the pivotable armature 119 is adjustable by using the selecting means 134A. In order to render ineffectual the response selectivity of the magnetic triggering apparatus 10, the adjusting screw 135 is fully inwardly turned. In this manner, the lever 136 engages this adjusting screw 135 and holds the pivotable armature 119 in its operative position against the force of the pivotable armature spring 126A which is not illustrated in this FIG. 2 of the drawings. As will be described further hereinbelow and with this setting, the switch lock mechanism 20 is tripped each time when the magnetic triggering apparatus 10 is activated and thus a definitive switch-off takes place already during a first short-circuit current half-cycle. By unscrewing the adjusting screw 135 from the aforementioned position, the selectivity can be preselected in an infinitely variable manner.

The inventive magnetic triggering apparatus or magnetic trigger as shown in FIGS. 1 and 2 operates as follows:

In the switch-off position of the selectively operative switch 1 as illustrated in FIG. 2, the actuating rod 201 of the switch lock mechanism 20 locks the movable contact 301 in the switch-off or open position against the force of the contact pressure spring 309. Upon actuating the switch lock mechanism 20, the actuating rod 201 ia pivoted in clockwise direction. The movable contact 301 is thereby moved into the switch-on position under the force of the contact pressure spring 309 and closes the contact between the contact heads 306 and 307 as shown in FIG. 1. The adjusting screw 135 of the selecting means 134A may be fully outwardly rotated so that the end of the short leg of the substantially L-shaped pivotable armature 119 is supported at the upper leg 123 of the substantially U-shaped iron enclosure 107.

When the current flowing through the magnetic coil or winding 101 exceeds the predetermined threshold or tripping current for opening the selectively operative switch 1, the plunger-type armature 10 is pulled into the magnetic coil or winding 101. As a consequence, the plunger 104 engages at the stop dog 308 and thrusts the movable contact 301 into an open position against the force of the contact pressure spring 309. An electric arc forming between the contact heads 306 and 307 is driven to the right, as viewed in FIGS. 1 and 2, into the extinguishing or quenching chamber by means of the abovementioned U-shaped guide rail. The arc voltage produced thereby reduces and limits the short-circuit current.

However, up to this point the switch lock mechanism 20 has not yet tripped because the tripping means 113, 115 have not been activated. The opening movement of the movable contact 301 is transmitted by means of the extension 302 to the plunger portion 130 engaged therewith. The pivotable armature 119 and the plunger portion 129 still remain in their rest or inoperative position due to their relatively large mass and the action of the compression spring 134. The pivotable armature 119 is pivoted into its operative position in accordance with FIG. 2 only after the contacts have been practically fully opened. The time delay between the deflection of the pivotable armature 119 into its operative position and the response of the plunger-type armature 103 to the threshold current is adjusted such that the pivotable armature 119 is pivoted out as shown in FIG. 2 during a following second current half-cycle.

If a subordinate or secondary switch which may constitute a protective switch such as, for example, a relay has not been switched off, the magnetic flux caused by the current flowing through the magnetic coil or winding 101 during such second current half-cycle, as a result of the deflected pivotable armature 119, is redirected from the upper leg 123 of the substantially U-shaped iron enclosure 107 to the flange 112 and the tripping lever 113 as well as to the pivotable armature 119 which defines a magnetic return path for the magnetic return flux. As a result, a magnetic force becomes effective between the pole shoes 117 and 118 and causes the tripping lever 113 to swivel out in anticlockwise direction. The tripping rod 115 transmits this movement to the switch lock mechanism 20 which, in turn, trips the operating rod 201 and thereby locks the movable contact 301 in the switch-off or open position shown in FIG. 2.

If the response selectivity is rendered ineffectual using the selecting means 134A as described hereinbefore, the pivotable armature 119 is fixed in the operative position shown in FIG. 2. Then, the tripping lever 113 is actuated already during the first current half-cycle.

From the foregoing it will be quite apparent that the time delay or response time, which leads to tripping of the switch lock mechanism 20, can be preset by selecting the position of the adjusting screw 135.

A second exemplary embodiment of an inventive magnetic triggering apparatus or magnetic trigger 10A is illustrated in FIGS. 3 to 7.

The difference from the aforedescribed first exemplary embodiment of the inventive magnetic triggering apparatus 10 essentially resides in the fact that, in the rest or inoperative position of the pivotable armature 119, the magnetic flux flows through the tripping lever 113A and the pivotable armature 119A and is redirected into the left leg 137 of the iron enclosure 107A shown in FIG. 3 only during the second current half-cycle.

In the magnetic triggering apparatus 10A, the tripping lever 113A is pivotably mounted at a lug 138 at the right leg 139 of the iron enclosure 107A. The tripping rod 115 is fixedly connected with the tripping lever 113A, so that the movements of the tripping lever 113A are transmitted as pivoting movements of the tripping rod 115 to the switch lock mechanism 20 which is not specifically illustrated in FIG. 3. In the rest or inoperative position, the retaining spring 120 pulls the tripping lever 113A against a stop member 404 connected, for example, as by casting with the housing.

The pivotable armature 119A is rotatably supported at a lug 121A bent-off from the left leg 137 of the iron enclosure 107A and biased by means of the hinge-type armature spring 126B, which is supported at the housing 40 by means of a retainer 405. The pivotable armature 119A is supported at the plunger-type armature 103. For this purpose, the pivotable armature 119A is provided with a deformed or protruding section 140 in the area of contact with the plunger-type armature 103 and this deformed section 140 protrudes towards the plunger-type armature 103. FIG. 7 shows the pivotable armature 119A in elevation; also indicated are the plunger-type armature 103 containing a plunger-type armature extension 141 which extends through the fork-like cut-out pivotable armature 119A. The line of contact between the plunger-type armature 103 and the deformed section 140 is designated by the reference character 142.

When the threshold or tripping current is reached, the plunger-type-armature 103 is pulled into the magnetic coil or winding 101 against the force of the return spring 110A. The pivotable armature 119A is capable of following this movement until the deformed section 140 engages the left leg 137 of the iron enclosure 107A. The overlap between the pole shoes 117A and 118A is thereby increased in the presently described more simply constructed second embodiment of the inventive triggering apparatus. Due to the much larger air gap between the tripping lever 113A and the left leg 137 of the iron enclosure 107A, the magnetic return flux path is closed by the right leg 139 of the iron enclosure 107A, the tripping lever 113A and the pivotable armature 119A. Therefore, the switch lock mechanism 20 does not receive a tripping command during this phase of the operation.

When the current of the first short-circuit current half-cycle falls below the threshold current, the plunger-type armature 103 moves back under the force of the return spring 110A and impacts at the deformed section 140 of the pivotable armature 119A. The overlap between the pole shoes 117A and 118A is removed due to the anticlockwise rotary movement of the pivotable armature 119A. The moments of inertia of the pivotable armature 119A and the spring characteristic of the pivotable armature spring 126B are mutually adapted such that an overlap between the pole shoes 117A and 118A can only re-occur during a second short-circuit current half-cycle. During such second short-circuit current half-cycle, the tripping lever 113A is attracted because, when the pivotable armature 119A is deflected, the magnetic flux commutates or is redirected into the left leg 137 of the iron enclosure 107A.

In the modification shown in FIG. 4, the return spring 110A and the retaining spring 120 are replaced by a common spring 143. This common spring 143 is supported at one end at the tripping lever 113A and at the other end at an extension 144 of the pivotable armature 119A.

In the modification shown in FIG. 5, the pivotable armature spring 126B and the return spring 110A are replaced by a common spring 145. This common spring 145 is attached at one end to the extension 141 of the plunger-type armature 103 and at the other end to a lever 146 fixedly connected with the pivotable armature 119A. The response selectivity of this modification of the magnetic triggering apparatus 10A is also adjustable. The adjusting screw 135 of the selecting means 134A shown in FIG. 2 also acts on the lever 136 which is connected, for example, as by casting with the pivotable armature 119A. When the adjusting screw 135 is fully inwardly turned, the pivotable armature 119A is pivoted out of the area of the overlap between the pole shoes 117A and 118A and the tripping lever 113A is attracted during each current half-cycle which reaches the level of the threshold or tripping current.

FIG. 6 shows a view of the left leg 137 of the iron enclosure 107A and the plunger-type armature 103. A tongue designated by the reference character 147, holds the plunger-type armature 103 in the rest or inoperative position against the force of the return spring 110A.

The selectively operative switch described hereinbefore may operate selectively according to various triggering characteristics. When the response selectivity is rendered ineffectual, the adjusting or adjustment screw 135 of the selecting means 134A is fully inwardly turned and the contacts 301 and 303 open to limit the current each time the current flowing through the magnetic coil or winding 101 is sufficiently great so that the plunger-type armature 103 is pulled into the magnetic coil or winding 101 against the force of the return spring 110A. The magnitude of the threshold or tripping current intended to trip the switch lock mechanism 20, can be selected by choosing the appropriate characteristic for the retaining spring 120.

When the response selectivity is effective in the sense that the adjusting screw 135 is completely outwardly turned, the switch lock mechanism 20 is tripped each time during the second short-circuit current half-cycle, which follows the first short-circuit current half-cycle within approximately 10 to 15 milliseconds. If a subordinate or secondary switch, for example, a protective switch such as, for instance, a relay successfully switches off during the first short-circuit current half-cycle, the switch lock mechanism 20 is not tripped and the movable contact 301 returns into the closed position under the action of the contact pressure spring 309.

By adjusting the selecting means 134A to an intermediate position between the aforementioned two extreme positions, a current-dependent, selective operation of the selectively operative switch is rendered possible.

FIG. 3 shows in broken lines a further modification for actuating the pivotable armature 119A. A two-armed angled lever 148 is rotatably mounted at its central region and supported at one end in the switch-on position at a further dog 149 at the movable contact 301. A spring 150 acts upon the other end of the two-armed angled lever 148. In the switch-on position, the two-armed angled lever 148 is held in the illustrated position by means of the movable contact 301. When the contact is opened, the two-armed angled lever 148 is released and, under the force of the spring 150, moves the pivotable armature 119A against the force of the pivotable armature spring 126B into the deflected position. The time delay between the opening of the contacts 306 and 307 and the deflection of the pivotable armature 119A is determined by the mass and spring ratios in this modification.

While there are shown and described present preferred embodiments of the invention, it is to be distinctly understood that the invention is not limited thereto, but may be otherwise variously embodied and practiced within the scope of the following claims. Accordingly,

What we claim is:

1. A magnetic triggering apparatus for a selectively operative switch, comprising:

a plunger-type armature containing a plunger for operating upon contacts of the selectively operative switch;

a magnetic coil for actuating said plunger-type armature and said plunger for operating upon said contacts of said selectively operative switch in the presence of a current flowing through said magnetic coil and at least corresponding to a predetermined threshold current;

a pivotable armature arranged at said magnetic coil;

said pivotable armature being operatively associated with said plunger-type armature;

said magnetic coil defining a magnetic flux;

said pivotable armature defining a magnetic return path for a magnetic return flux of the magnetic flux defined by said magnetic coil;

a switch lock mechanism for locking said selectively operative switch in a predetermined switching state;

tripping means operatively associated with said switch lock mechanism; and said tripping means acting upon said switch lock mechanism for locking said selectively operative switch in said locked predetermined switching state.

2. The magnetic triggering apparatus as defined in claim 1, wherein:

said magnetic coil comprises an iron enclosure at least partially enclosing said magnetic coil;

said tripping means being pivotably mounted at said iron enclosure;

said tripping means containing a pole shoe;

said pivotable armature containing a pole shoe; and said tripping means and said pivotable armature being displaceable relative to each other such that said pole shoe of said pivotable armature and said pole shoe of said tripping means are arranged in an overlapping relationship.

3. The magnetic triggering apparatus as defined in claim 2, wherein:

said pivotable armature abuts against said iron enclosure in an inoperative position of said pivotable armature; and said pivotable armature being pivotable into the region of said pole shoe of said tripping means.

4. The magnetic triggering apparatus as defined in claim 2, wherein:

said pivotable armature is pivotably arranged for pivoting about a predetermined pivot axis;

said pivotable armature having a substantially L-shape;

said substantially L-shaped pivotable armature containing a bent-off member at an end remote from said pivot axis; and said bent-off member of said pivotable armature being constructed as said pole shoe of said pivotable armature.

5. The magnetic triggering apparatus as defined in claim 1, further including:

a pivotable armature spring holding said pivotable armature in an inoperative position;

a transmitting plunger having two ends;

a first end of said two ends of said transmitting plunger engaging said pivotable armature; and a second end of said transmitting plunger being operatively associated with a movable contact of said selectively operative switch.

6. The magnetic triggering apparatus as defined in claim 5, wherein:

said second end of said transmitting plunger engages an extension extending from said movable contact at least during the operation of said plunger-type armature upon said movable contact.

7. The magnetic triggering apparatus as defined in claim 5, wherein:

said transmitting plunger is subdivided into two plunger portions; and said plunger portions being connected with each other by means of a compression spring.

8. The magnetic triggering apparatus as defined in claim 2, wherein:

said pivotable armature can assume an inoperative position;

said pole shoe of said pivotable armature and said pole shoe of said tripping means bring arranged in said overlapping relationship in said inoperative position of said pivotable armature; and said pivotable armature being pivotable such that pole shoe of said pivotable armature is pivoted out of said overlapping relationship with said pole shoe of said tripping means.

9. The magnetic triggering apparatus as defined in claim 8, further including:

a pivotable armature spring holding said pivotable armature in its operative position;

said pivotable armature, in its inoperative position, bearing upon said plunger-type armature;

an abutment operatively associated with said pivotable armature;

said pivotable armature, during actuation of said plunger-type armature, following said plunger-type armature under the action of said pivotable armature spring until abutting said abutment and thereby increasing the overlap between said pole shoe of said pivotable armature and said pole shoe of said tripping means; and said pivotable armature, under the action of said plunger-type armature during its return movement after actuation, being pivoted such that said pole shoe of said pivotable armature is pivoted out of said overlapping relationship with said pole shoe of said tripping means.

10. The magnetic triggering apparatus as defined in claim 1, further including:

adjustable selecting means operatively associated with said pivotable armature in said inoperative position of said pivotable armature;

a pivotable armature spring holding said pivotable armature in an inoperative position; and said adjustable selecting means being adjustable for adjusting said inoperative position of said pivotable armature against the force of said pivotable armature spring.

11. The magnetic triggering apparatus as defined in claim 10, wherein:

said adjustable selecting means constitute an adjustable screw directly abutting said pivotable armature.

12. The magnetic triggering apparatus as defined in claim 10, further including;

a lever connected with said pivotable armature; and said adjustable selecting means constituting an adjustment screw engaging said lever.

* * * * *